United States Patent [19]

McFarland

[11] 4,407,309

[45] Oct. 4, 1983

[54] HAIR STYLING METHOD

[76] Inventor: James G. McFarland, 1106 Rainbow Trail, Milford, Ohio 45150

[21] Appl. No.: 309,259

[22] Filed: Oct. 7, 1981

[51] Int. Cl.[3] ..... A45D 24/36

[52] U.S. Cl. ..... 132/45 R; 132/7; 132/11 R

[58] Field of Search ..... 132/11 R, 45 R, 150, 132/149, 156–157; D86/8

[56] References Cited

U.S. PATENT DOCUMENTS

| | | | |
|---|---|---|---|
| D. 221,114 | 7/1971 | Rogovin . | |
| 567,910 | 9/1896 | Mathews . | |
| 655,895 | 8/1900 | Cooper . | |
| 2,101,132 | 12/1937 | Daly et al. | 132/11 R |
| 2,305,969 | 12/1942 | Larson . | |
| 3,125,101 | 3/1964 | Clark . | |
| 3,277,902 | 10/1966 | Korst . | |
| 3,792,707 | 2/1974 | Tupper . | |

*Primary Examiner*—Gregory E. McNeill

*Attorney, Agent, or Firm*—Wood, Herron & Evans

[57] ABSTRACT

A method of styling hair wherein the hair is combed upwardly by a comb having teeth defining an included angle of from 15° to 75°. The hair entrapped between these angled teeth is cut parallel to the side of the comb so as to form multiple groups of hair configured generally as truncated pyramids. After cutting, the hair tends to fall back into the center of the pyramids so as to naturally maintain the hair fluffed outwardly away from the scalp in the style in which it was originally cut.

1 Claim, 7 Drawing Figures

HAIR STYLING METHOD

This invention relates to the cutting of hair and more particularly to the cutting of hair in the fashion which is commonly referred to as "styled".

Hair on a person's head naturally falls out and downwardly from the crown of the head. If not cut and groomed regularly, it has a "shaggy dog" appearance in which it falls down over the eyes, ears and neck. To avoid that appearance, hair is commonly cut by combing it upwardly toward the crown of the head and cutting the hair parallel to the side of the comb. The length of the hair after cutting is determined by the distance the comb is held from the head when the cutting occurs. The result of this type of traditional cutting is a haircut in which the hair lies against the scalp and falls downwardly away from the crown. The cut may be shaped slightly as by parting the hair or combing it sideways across the forehead.

In the past several years there has been a trend away from the traditional haircut and toward "styled" haircuts. Styled haircuts are generally defined as cuts in which hair may be blown dry and instead of falling flat against the scalp, remains fluffed out away from the head in the pattern in which it was originally cut.

The fluffed out or "styled" appearance is generally achieved by a special cutting process. This process may vary slightly from one stylist to another, but in general the principle is to cut with the comb angled first in one direction as it is moved upwardly toward the crown of the head and then angled in a reverse direction in a second cut over the same area. The result is that the hair cut in the first cut tends to fall across hair cut in the second cut and remain fluffed or standing away from the scalp rather than all falling parallel against the scalp.

The difficulty with styling cuts is that they are very time consuming to cut and are difficult to learn or to teach someone else to cut.

It has therefore been one objective of this invention to provide a new method of cutting hair styling cuts which is easy to learn or to teach and which may be more quickly cut by most barbers or stylists.

Additionally, it has been another objective of this invention to provide a new hair styling comb which may be used in the cutting of styling type haircuts and which will enable any barber or stylist to cut "styled" hair.

These objectives are accomplished according to the practice of this invention by using a comb having angled teeth for holding the hair spaced from the scalp during the cutting process. The teeth of the comb preferably define included angles of from fifteen (15°) degrees to seventy-five (75°) degrees. This comb tends to form the hair into generally pyramid shaped groups which, when cut, have the configuration of truncated pyramids. These cut groups tend to fall inwardly toward the axis of the individual pyramids with the result that when blown dry, the hair remains spaced from the scalp in the over configuration imparted during the cutting.

The advantage of using this comb in cutting styled hair is that it enables any barber to quickly learn to cut styled haircuts and it expedites the cutting of such haircuts.

These and other objects and advantages of this invention will be more readily apparent from the following description of the drawings in which.

Before it is possible to understand this invention, it is necessary to appreciate the difference between a conventional or unstyled haircut and a styled haircut. Conventional haircuts are generally cut so that the hair extends downwardly from the crown of the head or from a part line on one side of the crown and lies flat against the side of the head. A styled haircut, on the other hand, is one in which the hair also extends downwardly from the crown or from a part line but when blown dry stands out away from the head in the configuration of the original haircut. In a styled haircut, the individual hairs do not lie parallel to one another but tend to cross with the result that even when the hair is blown dry it retains the original styled configuration in which it stands out away from the scalp in a fluffed appearance.

Figure 1:
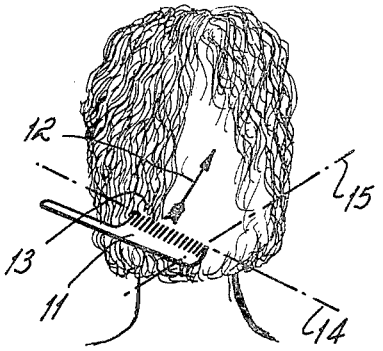
FIG. 1 is a diagrammatic perspective view of a prior art method of cutting a "styled" haircut.
Figure 2:
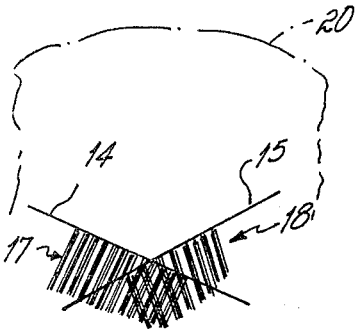
Fig. 2 PRIOR ART
FIG. 2 is an enlarged and diagrammatic fragmentary perspective view of a portion of FIG. 1.

In order to obtain a styled haircut using the presently available cutting equipment, it is generally the practice of a barber or hair stylist to cut the hair with the aid of a conventional comb 11 by moving the comb 11 upwardly in strokes parallel to the scalp as indicated by the arrow 12. In order to force the hair into a crossed pattern though, the edge 13 of the comb is angled as indicated by the fall lines 14 and 15 first in one direction relative to the upward stroke direction 12 of the comb, and then in an opposite direction. After each short upward stroke of the comb in the direction 12 scissors or a clipper are moved across the edge of the comb so as to cut the hair parallel to the face of the comb. As a consequence of this cutting technique the hair cut on one stroke indicated by numeral 17 in FIG. 2, lies across or generally perpendicular to the hair 18 cut on the next following crossed stroke. In other words, the hair 17 cut during one stroke when a comb is angled in a first direction lies crosswise or in an angled relation relative to the hair 18 cut with the comb angled in the opposite direction. The result is that the hair cut in this way tends to fall back into the crosswise pattern 17 and 18 when it is blown dry or allowed to assume its natural position, and if the hair has sufficient length in the course of falling crosswise relative to adjacent hairs, the hair will tend to remain partially upstanding away from the scalp 20.

The difficulty with this prior art method of cutting styled haircuts is that it is extremely difficult to teach a new barber to cut. It is also a very time consuming haircut for even a skilled barber or stylist to cut.

Figure 5:
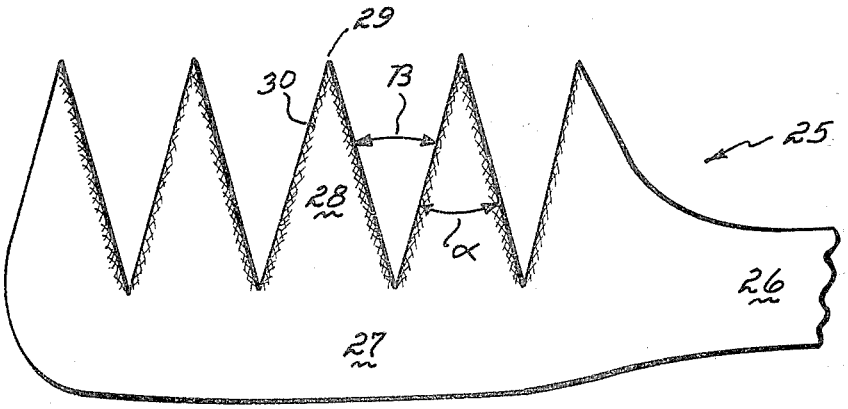
FIG. 5 is a side elevational view of the novel comb used in the practice of this invention.
Figure 6:
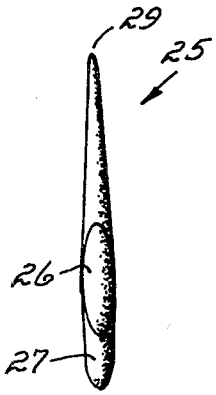
FIG. 6 is an end elevational view of the comb of FIG. 5.

With reference now to FIG. 5, there is illustrated a comb 25 of this invention which facilitates the cutting of a styled haircut and eliminates the need for the barber or stylist to first angle the comb in one direction and then in an opposite direction in order to obtain the desired crossing pattern of hair which maintains the hair partially upstanding or fluffed away from the scalp.

The comb 25 is generally planar in configuration and comprises a handle 26, a base section 27, and multiple teeth 28 extending from one edge of the base section 27. In the embodiment illustrated in FIG. 5 there are five teeth, each of which is triangular in configuration and each of which is tapered to an end point 29. Each tooth defines an included angle $\alpha$ of approximately 30°. Additionally, an angle $\beta$ is defined between each pair of adjacent teeth 28 and in the preferred embodiment of FIG. 5 this angle $\beta$ is also equal to 30°. Preferably, the side walls 30 of each tooth 29 are rounded and partially serrated so as to define a non-slip or low slip surface.

Figure 7:
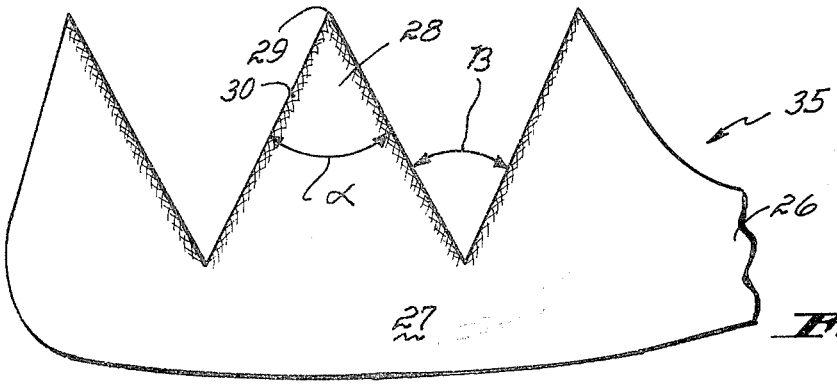
FIG. 7 is a side elevational view of an alternative embodiment of the comb employing the invention of this application.

With reference to FIG. 7 there is illustrated a second embodiment of comb 35. This embodiment is generally identical to the embodiment of FIG. 5 except that the triangular shaped teeth define an included angle $\alpha$ on each tooth of approximately 45° and the adjacent teeth define an included angle $\beta$ between them of approximately 45°. In all other respects the comb 35 is identical to the comb 25.

Figure 3:
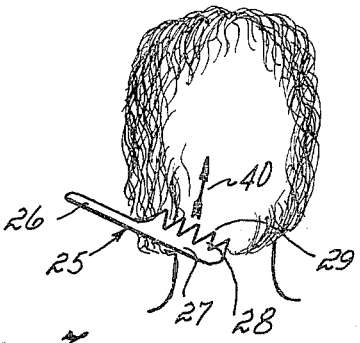
FIG. 3 is a perspective view similar to FIG. 1 but illustrating the improved method of this invention for cutting a styled haircut.
Figure 4:
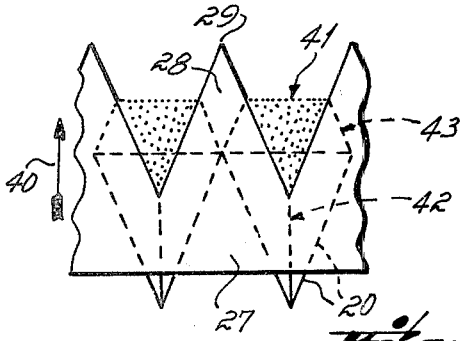
FIG. 4 is an enlarged and diagrammatic fragmentary perspective view of a portion of FIG. 3.

With reference now to FIGS. 3 and 4 there is illustrated the manner in which the combs 25 and 35 are used in the cutting of a styled haircut. In general, it will be seen that the comb is stroked upwardly toward the crown of the head in short strokes indicated by arrow 40 so as to lift the hair outwardly. The comb though is oriented with the leading edge or teeth of the comb perpendicular to the direction of the stroke 40 as indicated by the dashed line 41 in FIG. 3.

With reference now to FIG. 4, it will be seen that in the use of the comb 25 or 35 the angled teeth tend to entrap generally pyramid shaped groups of hair 41 between each pair of teeth. When these groups 41 are subsequently cut, the result is a generally truncated pyramid shaped group of hair having longer strands 42 located about the periphery of the group and shorter strands 43 located toward the center of the group. When the comb is removed and the hair allowed to fall naturally it tends to fall inwardly upon the center of the pyramid shaped grouping 41 and to thereby remain upstanding with the hair on one side of the pyramid collapsing across hairs on the other side of the pyramid. The result is that when the hair is subsequently blown dry it tends to return to the crossing pattern in which the hairs cross and thereby remain partially upstanding away from the scalp in the fluffed or styled configuration into which the hair was originally cut.

The advantage of using the comb 25 or 35 to cut styled hair is that it renders the cutting much easier for a barber since there is no need to angle the comb relative to the crown of the head so as to obtain the crossing patterns of hair required to maintain the hair upstanding away from the scalp. In addition to rendering the cutting of styled hair easier to practice and thus easier for a teacher to teach, this comb expedites the cutting of a styled haircut so that even a skilled barber can practice the "styled" cutting more efficiently than was heretofore possible with conventional combs.

While I have illustrated only two embodiments of my comb, persons skilled in this art will appreciate that the angle of the teeth $\alpha$ and the angle $\beta$ defined between adjacent teeth as well as the number of teeth may be varied without departing from the spirit of my invention. These angles may vary anywhere from 15° to 75° depending upon the length and style of hair to be cut. In general, lesser angles and greater numbers of smaller teeth are utilized with short haircuts and fewer number of teeth with greater angles are used in cutting longer hair. Therefore, I do not intend to be limited except by the scope of the following appended claims.

I claim:

1. The method of cutting or styling haircuts which comprises utilizing a generally flat, rigid, planar comb having multiple teeth, each tooth of which defines an included angle of between 15° and 75°, which method comprises moving said comb in multiple strokes generally parallel to the contour of the head upwardly toward the crown of the head so as to force hair entrapped between pairs of said teeth of said comb into a crossed pattern as a consequence of said comb movement resulting in hair on the left side of a first tooth engaging and being forced leftwardly relative to that first tooth, while hair on the right side of an adjacent tooth located on the left side of said first tooth is forced to the right to create said crossed pattern of groups of hair entrapped between adjacent pairs of teeth of said comb, cutting said groups of hair entrapped between said teeth of said comb in a plane parallel to said comb so as to form said groups of cut hair into the configuration of truncated pyramids, the individual hairs of said truncated pyramids tending to fall across one another and thereby remain upstanding away from the scalp so as to retain a styled appearance.

* * * * *